US008118557B2

(12) United States Patent
DeMania et al.

(10) Patent No.: US 8,118,557 B2
(45) Date of Patent: Feb. 21, 2012

(54) STEAM TURBINE ROTATING BLADE OF 52 INCH ACTIVE LENGTH FOR STEAM TURBINE LOW PRESSURE APPLICATION

(75) Inventors: Alan R. DeMania, Niskayuna, NY (US); F. Timothy Wendell, Fonda, NY (US)

(73) Assignee: General Electric Company, Schenectady, NY (US)

( * ) Notice: Subject to any disclaimer, the term of this patent is extended or adjusted under 35 U.S.C. 154(b) by 450 days.

(21) Appl. No.: 12/410,877

(22) Filed: Mar. 25, 2009

(65) Prior Publication Data

US 2010/0247315 A1 Sep. 30, 2010

(51) Int. Cl.
*F01D 5/22* (2006.01)

(52) U.S. Cl. ..... 416/191

(58) Field of Classification Search ..... 416/191, 416/223, 238

See application file for complete search history.

(56) References Cited

U.S. PATENT DOCUMENTS

| | | | | |
|---|---|---|---|---|
| 3,561,886 | A * | 2/1971 | Cohen | 416/224 |
| 5,067,876 | A | 11/1991 | Moreman, III | |
| 5,267,834 | A | 12/1993 | Dinh et al. | |
| 5,277,549 | A | 1/1994 | Chen et al. | |
| 5,299,915 | A | 4/1994 | Dinh et al. | |
| 5,393,200 | A | 2/1995 | Dinh et al. | |
| 5,480,285 | A | 1/1996 | Patel et al. | |
| 6,435,833 | B1 * | 8/2002 | Reluzco et al. | 416/222 |
| 6,435,834 | B1 * | 8/2002 | Reluzco et al. | 416/222 |
| 6,575,700 | B2 | 6/2003 | Arai et al. | |
| 6,682,306 | B2 | 1/2004 | Murakami et al. | |
| 6,814,543 | B2 | 11/2004 | Barb et al. | |
| 6,893,216 | B2 | 5/2005 | Snook et al. | |
| 7,097,428 | B2 | 8/2006 | Barb et al. | |
| 7,195,455 | B2 | 3/2007 | Stonitsch et al. | |
| 2007/0292265 | A1 | 12/2007 | Burdgick et al. | |
| 2010/0061857 | A1 * | 3/2010 | Bracken | 416/201 R |

OTHER PUBLICATIONS

Amir Mujezinovic, "Bigger Blades Cut Costs", Modern Power Systems, Feb. 2003, p. 25, 27.

Michael Boss, "Steam Turbine Technology Heats Up", PEI Magazine, Apr. 2003, p. 77, 79, 81.

* cited by examiner

*Primary Examiner* — Nathan Ha

(74) *Attorney, Agent, or Firm* — Dority & Manning, P.A.

(57) ABSTRACT

A bucket for use in the low-pressure section of a steam turbine engine is provided. The bucket has a vane length of at least about 52 inches. The bucket is comprised of a dovetail section disposed near an inner radial position of the bucket, a tip shroud disposed near an outer radial position of the bucket and a part span shroud disposed at an intermediate radial position. The intermediate radial position is disposed at a location between the inner and outer radial positions the intermediate radial positioning adapted to promote aerodynamic performance of the part span shroud. The bucket is comprised of a chromium steel.

20 Claims, 5 Drawing Sheets

STEAM TURBINE ROTATING BLADE OF 52 INCH ACTIVE LENGTH FOR STEAM TURBINE LOW PRESSURE APPLICATION

BACKGROUND OF THE INVENTION

The present invention relates to high strength buckets for use in the last stage of steam turbine engines. Specifically, the invention relates to the application of certain high strength blades as last stage turbine buckets having vane lengths of about 52 inches or greater.

It is generally recognized that the performance of a steam turbine is greatly influenced by the design and performance of later stage buckets operating at reduced steam pressures. Ideally, the last stage bucket should efficiently use the expansion of steam down to the turbine exhaust pressure, while minimizing the kinetic energy of the steam flow leaving the last stage.

The service requirements of steam turbine buckets can be complex and demanding. Last stage buckets, in particular, are routinely exposed to a variety of severe operating conditions, including the corrosive environments caused by high moisture and the carry-over from the boiler. Such conditions can lead to serious corrosion and pitting problems with the bucket material, particularly in longer, last stage turbine buckets having vane lengths of 52 inches or greater. Thus, for some time, last stage buckets for turbines have been the subject of repeated investigations and development work in an effort to improve their efficiency under harsh operating conditions since even small increases in bucket efficiency and life span can result in significant economic benefits over the life of a steam turbine engine.

Last stage turbine buckets are exposed to a wide range of flows, loads and strong dynamic forces. Thus, from the standpoint of mechanical strength and durability, the primary factors that affect the final bucket profile design include the active length of the bucket, the pitch diameter and the operating speed in the operative flow regions. Damping, bucket fatigue and corrosion resistance of the materials of construction at the maximum anticipated operating conditions also play an important role in the final bucket design and method of manufacture.

The development of larger last stage turbine buckets, e.g., those with vane lengths of about 52 inches or more, poses additional design problems due to the inertial loads that often push the strength capability of conventional bucket materials. Steam turbine buckets, particularly last stage buckets with longer vanes, experience higher tensile loadings and thus are subject to cyclic stresses which, when combined with a corrosive environment, can be very damaging to the bucket over long periods of use. In addition, the steam in the last stages normally is "wet," i.e., containing a higher amount of saturated steam. As a result, water droplet impact erosion of the bucket material often occurs in the last stage. Such erosion reduces the useable service life of the bucket and the efficiency of the steam turbine as a whole.

In the past, it has been difficult to find bucket materials capable of meeting all of the mechanical requirements for different end use applications, particularly mechanical designs in which longer vane buckets, i.e., those having vane lengths about 52 inches or more, have been employed. Invariably, the longer buckets have increased strength requirements and, as noted above, suffer from even greater erosion and pitting potential. The higher stresses inherent in longer vane designs also increase the potential for stress corrosion cracking at elevated operating temperatures because the higher strength required in the bucket material tends to increase the susceptibility to stress cracking at operating temperatures at or near 400 degrees Fahrenheit (F). The effects of pitting corrosion and corrosion fatigue also increase with the higher applied stresses in last stage buckets having longer vane lengths. Many times, an alloy selected to satisfy the basic mechanical design requirements of other turbine stages simply will not meet the minimum mechanical strength and erosion resistance requirements of last stage buckets.

In some applications, particularly for turbine operation at higher speeds, use of titanium buckets has provided necessary strength and corrosion resistance. However, it is well known that the cost of titanium far exceeds that of more conventional bucket materials, making use of titanium prohibitive for many uses in turbine buckets. Further, uncertainty about supplies of titanium material further reduces desirability for broad application.

Accordingly, a need exists in the art for a last stage bucket having longer vane length, improved stiffness, improved dampening characteristics and low vibratory stresses.

BRIEF DESCRIPTION OF THE INVENTION

In one aspect of the present invention a bucket for use in the low pressure section of a steam turbine is provided. The bucket is formed with a vane length of at least about 52 inches. The bucket includes a dovetail section disposed near an inner radial position of the bucket, a tip shroud disposed near an outer radial position of the bucket, and a part span shroud disposed at an intermediate radial position. The intermediate radial position is located between the inner and outer radial positions on a suction side and a pressure side of the vane and is disposed to enhance aerodynamic performance of the part span shroud. The bucket is comprised of a chromium-based stainless alloy.

In another aspect, a steam turbine is provided comprising a low pressure turbine section having a plurality of last stage buckets arranged about a turbine wheel. The last stage buckets have a vane length of about 52 inches or greater. At least one last stage bucket comprises a dovetail section disposed near an inner radial position of the bucket, a tip shroud disposed near an outer radial position of the bucket, and a part span shroud disposed at an intermediate radial position. The intermediate radial position is located between the inner and outer radial positions. The last stage buckets are comprised of a chromium-based stainless alloy.

DETAILED DESCRIPTION OF THE INVENTION

Figure 1:
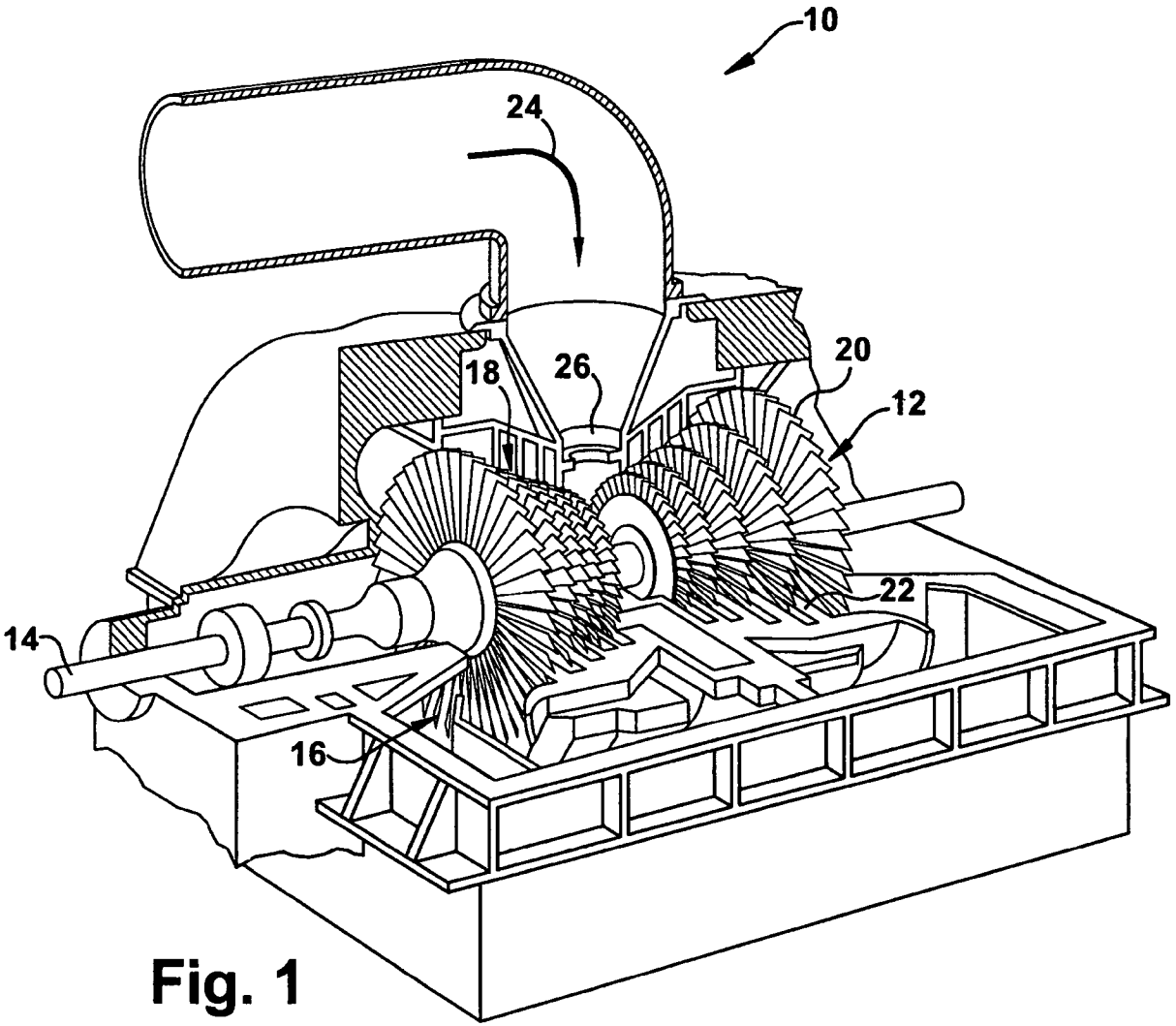
FIG. 1 is a perspective partial cut away illustration of a steam turbine.

FIG. 1 is a perspective partial cut away view of a steam turbine 10 including a rotor 12 that includes a shaft 14 and a low-pressure (LP) turbine 16. LP turbine 16 includes a plurality of axially spaced rotor wheels 18. A plurality of buckets 20 is mechanically coupled to each rotor wheel 18. More specifically, buckets 20 are arranged in rows that extend circumferentially around each rotor wheel 18. A plurality of stationary nozzles 22 extend circumferentially around shaft 14 and are axially positioned between adjacent rows of buckets 20. Nozzles 22 cooperate with buckets 20 to form a turbine stage and to define a portion of a steam flow path through turbine 10.

In operation, steam 24 enters an inlet 26 of turbine 10 and is channeled through nozzles 22. Nozzles 22 direct steam 24 downstream against buckets 20. Steam 24 passes through the remaining stages imparting a force on buckets 20 causing rotor 12 to rotate. At least one end of turbine 10 may extend axially away from rotor 12 and may be attached to a load or machinery (not shown), such as, but not limited to, a generator, and/or another turbine. Accordingly, a large steam turbine unit may actually include several turbines that are all coaxially coupled to the same shaft 14. Such a unit may, for example, include a high-pressure turbine coupled to an intermediate-pressure turbine, which is coupled to a low-pressure turbine.

In FIG. 1, and as one example embodiment, the low pressure turbine can be seen to have five stages. The five stages can be referred to as L0, L1, L2, L3 and L4. L4 is the first stage and is the smallest (in a radial direction) of the five stages. L3 is the second stage and is the next stage in an axial direction. L2 is the third stage and is shown in the middle of the five stages. L1 is the fourth and next-to-last stage. L0 is the last stage and is the largest (in a radial direction). It is to be understood that five stages are shown as one example only, and a low pressure turbine can have more or less than five stages.

Figure 2:
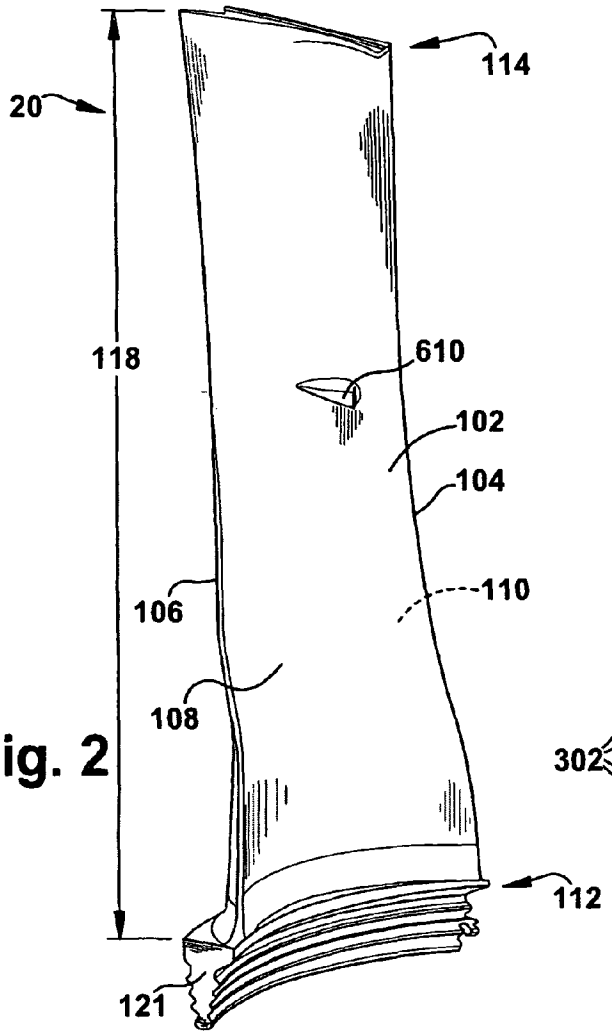
FIG. 2 is a perspective illustration of a bucket according to one embodiment of the present invention.

FIG. 2 is a perspective view of a turbine bucket 20 that may be used with turbine 10. Bucket 20 includes a blade portion 102 that includes a trailing edge 104 and a leading edge 106, wherein steam flows generally from leading edge 106 to trailing edge 104. Bucket 20 also includes a first concave sidewall 108 and a second convex sidewall 110. First sidewall 108 and second sidewall 110 are connected axially at trailing edge 104 and leading edge 106, and extend radially between a rotor blade root 112 and a rotor blade tip 114. A blade chord distance is a distance measured from trailing edge 104 to leading edge 106 at any point along a radial length 118 of blade 102. In the exemplary embodiment, radial length 118 or vane length is approximately fifty-two inches. In other embodiment, length 118 may vary. Although radial length 118 is described herein as being equal to approximately 52 inches, it will be understood that radial length 118 may be any suitable length for radial length 118 depending on the specific application. Root 112 includes a dovetail 121 used for coupling bucket 20 to a rotor disk along shaft 14.

Figure 3:
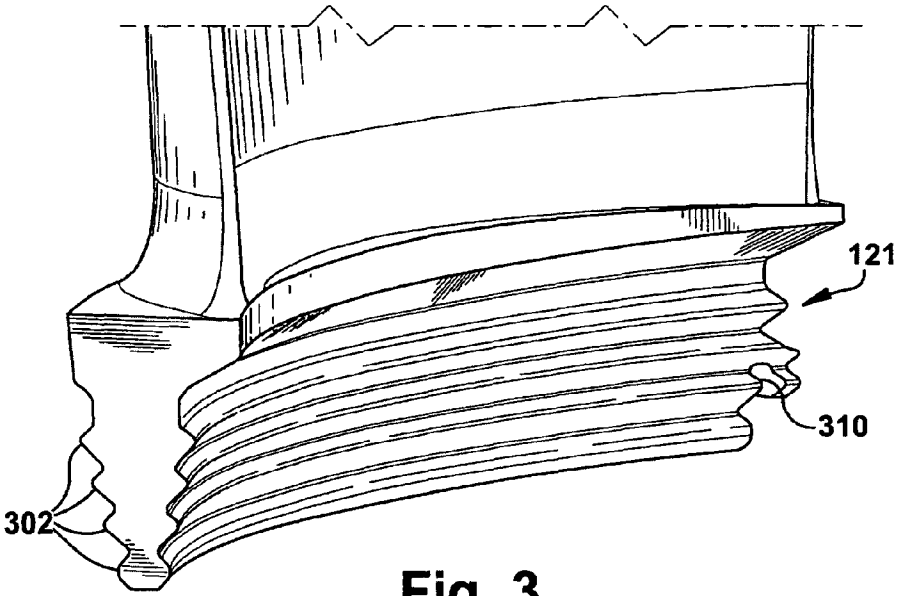
FIG. 3 is an enlarged, perspective illustration of the curved, axial entry dovetail according to one embodiment of the present invention.

FIG. 3 illustrates an enlarged view of dovetail 121. In the exemplary embodiment, dovetail 121 is a curved axial entry dovetail that engages a mating slot defined in the rotor disk. In one embodiment, the dovetail 121 has four convex projections (hooks) 302. In other embodiments, dovetail 121 could have more or less than four convex projections. The curved axial entry dovetail is preferred in order to obtain a distribution of average and local stress, protection during over-speed conditions and adequate low cycle fatigue (LCF) margins. Axial retention feature 310 receives a split lockwire (not shown) to prevent axial movement of the bucket when installed in the wheel.

Figure 4:
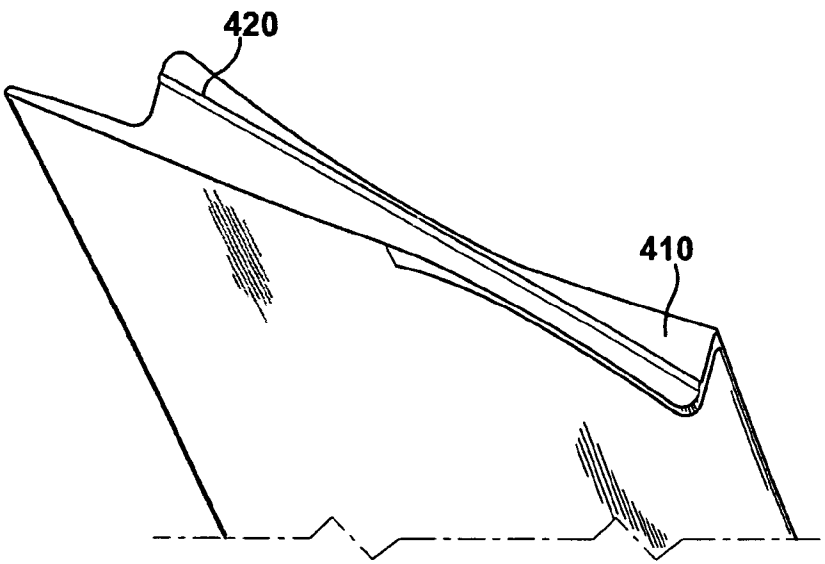
FIG. 4 is a perspective illustration of one embodiment of a tip shroud that can be used with the bucket of FIG. 2.

FIG. 4 illustrates an enlarged view of one embodiment of a bucket tip 114 having an integral tip shroud 410. The tip shroud 410 improves the stiffness and damping characteristics of bucket 20. A sealing rib 420 can be placed on the outer surface of the tip shroud. The rib 420 functions as a sealing means to limit steam flow past the outer portion of bucket 20. Rib 420 can be a single rib or formed of multiple ribs, a plurality of straight or angled teeth, or one or more teeth of different dimensions (e.g., a labyrinth type seal).

Figure 5:
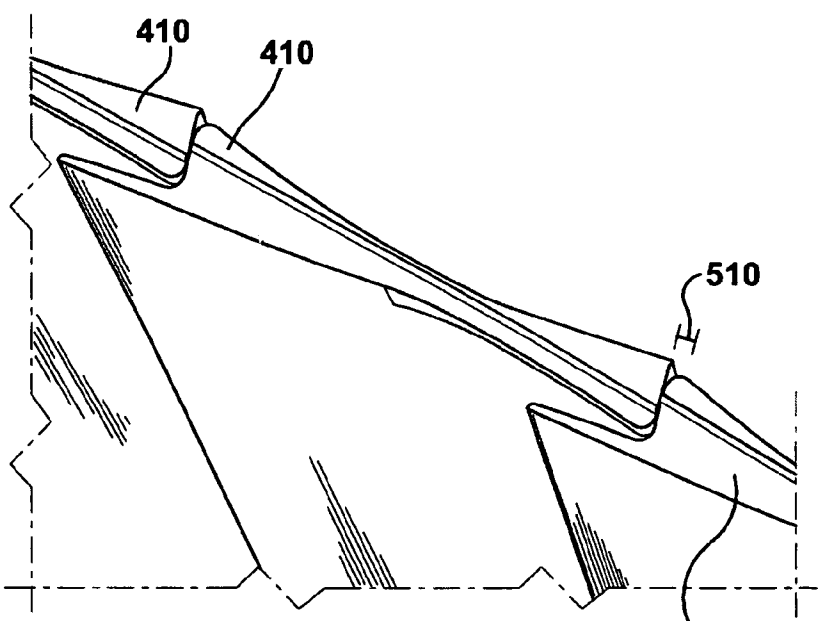
FIG. 5 is a perspective illustration showing the interrelation of adjacent tip shrouds.

FIG. 5 illustrates an initially assembled view of the tip shrouds 410. The tip shrouds 410 are designed to have a gap 510 between adjacent tip shrouds, during initial assembly and/or at zero speed conditions. As can be seen, the ribs 420 are also slightly misaligned in the zero-rotation condition. As the turbine wheel is rotated the buckets 20 begin to untwist. As the RPMs approach the operating level (e.g., about 1800), the buckets untwist due to centrifugal force, the gaps 510 close and the ribs 420 become aligned with each other. The interlocking shrouds provide improved bucket stiffness, improved bucket damping, and improved sealing at the outer radial positions of buckets 20.

Figure 6A:
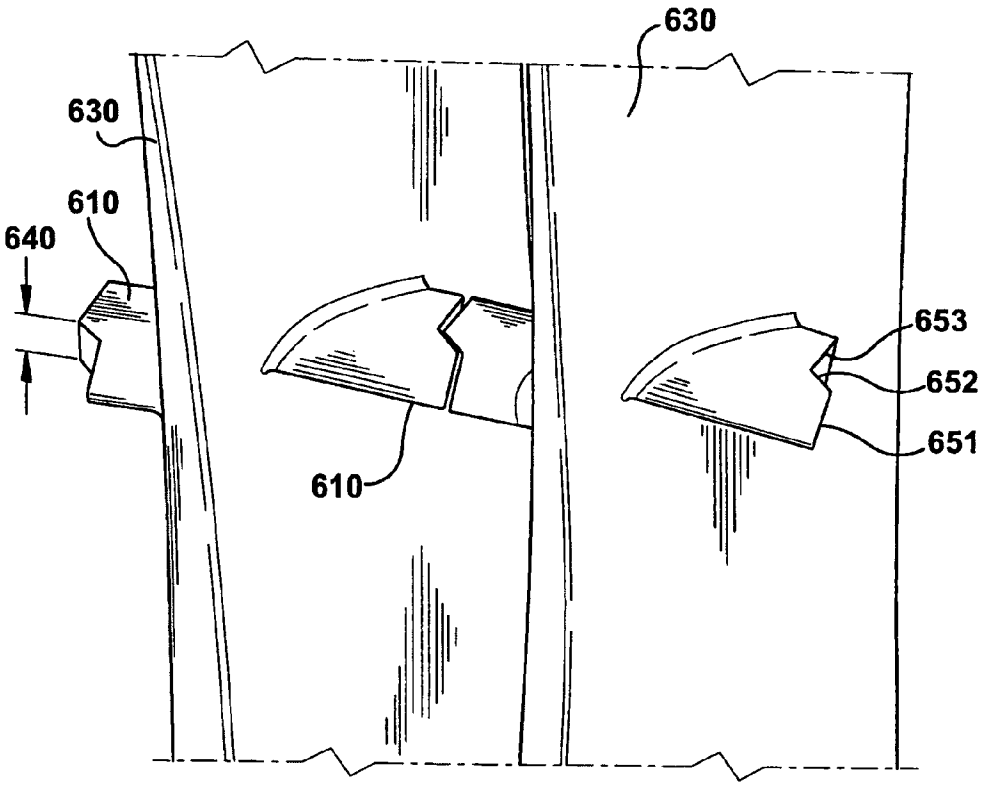
FIG. 6A is a perspective illustration showing the interrelation of adjacent part span shrouds.
Figure 6:
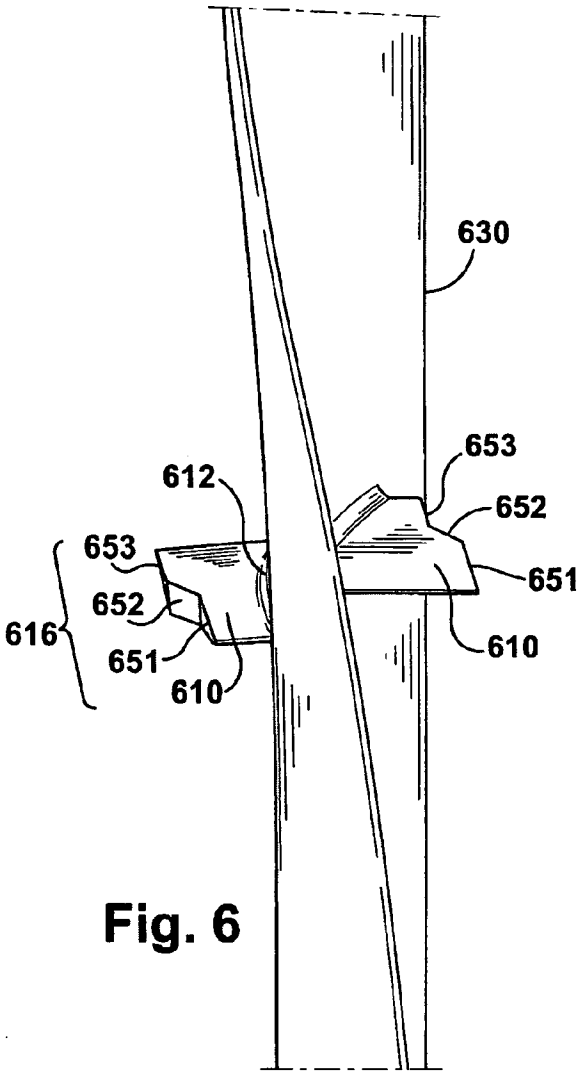
FIG. 6 is a perspective illustration of the part span shrouds that can be used with the bucket of FIG. 2.
Figure 7:
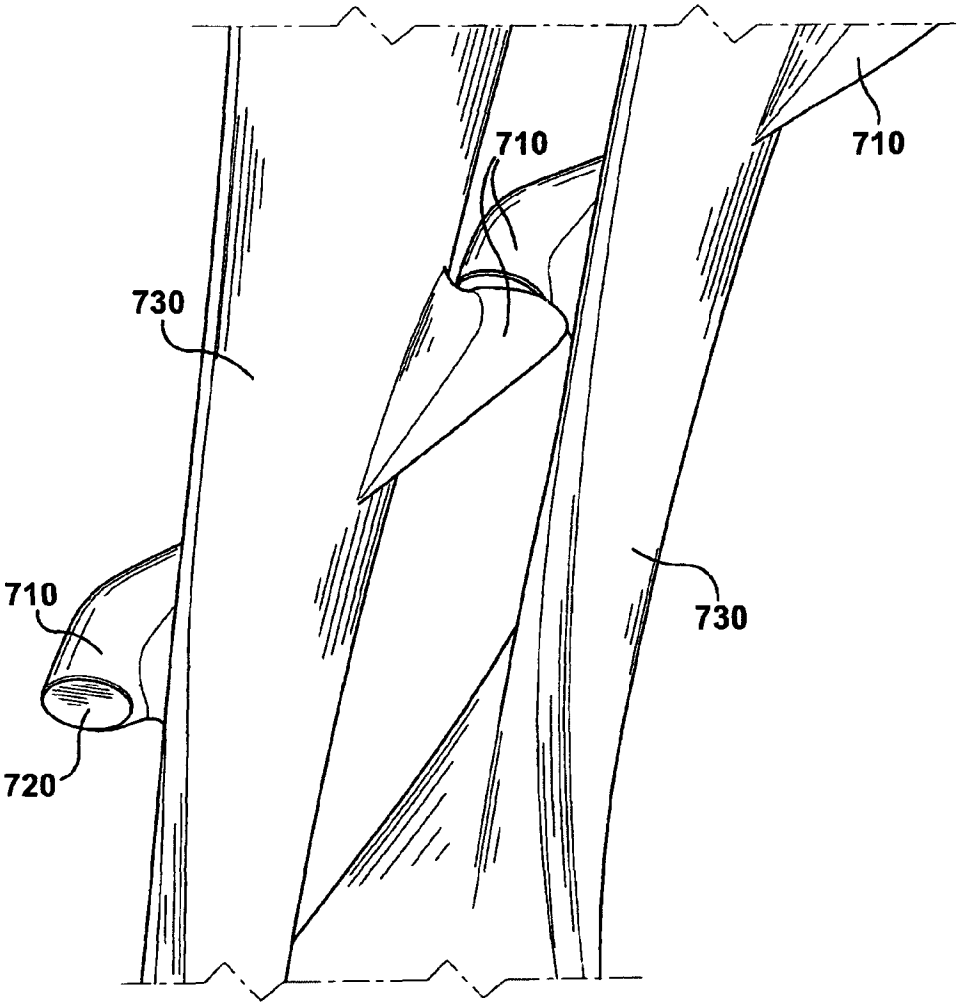
Fig. 7 (Prior Art)
FIG. 7 is a perspective illustration a contact surface for a prior art part span shroud.

FIG. 6 and FIG. 6A illustrate the part span shroud 610 located between the tip shroud 410 and root section 112. The part span shrouds 610 are located on the suction and pressure sidewalls of bucket 20. During zero-speed conditions, a gap exists between adjacent part span shrouds of neighboring buckets. This gap is closed as the turbine wheel begins to rotate and approach operating speed, and as the buckets untwist. The part span shrouds are aerodynamically shaped to reduce windage losses and improve overall efficiency. More specifically the part span shrouds 610 may be formed as a wing-shaped aerodynamic airfoil. Further the wing-shaped aerodynamic profile presented by the part span shrouds includes a substantially constant profile (wing thickness) 640 from the root end 615 at the blade 630 to the tip end 616. The tip end 616 of the part span shroud 610 is segmented including a first segment 651, a second segment 652 and a third segment 653, wherein the second segment is disposed between the first segment and the third segment. During operation at speed, the respective second segments 652 of adjacent buckets substantially take up the contact forces between the part span shrouds on adjacent buckets. The wing shape profile provides reduced aerodynamic drag over prior art part span shrouds 710 of FIG. 7 that have included expanded contact profiles 720 at the point of contact between part span shrouds on adjacent buckets 730. Further, the part span shroud for the present bucket is positioned approximately 46% between an inner radial position and an outer radial position on the vane at a location to further promote aerodynamic efficiency.

The bucket stiffness and damping characteristics are also improved as the part span shrouds contact each other during bucket untwist. As the buckets untwist, the tip shrouds 410 and part span shrouds 610 contact their respective neighboring shrouds. The plurality of buckets 20 behave as a single, continuously coupled structure that exhibits improved stiffness and dampening characteristics when compared to a discrete and uncoupled design. An additional advantage is a rotor exhibiting reduced vibratory stresses.

The bucket herein described can be comprised of chromium stainless alloy having the exemplary weight percentages shown below in Table 1:

TABLE 1

| (%) | | | | | | | | | | | | | |
|---|---|---|---|---|---|---|---|---|---|---|---|---|---|
| Cr | C | Mn | P | Mo | Ni | Si | Cu | W | Co | Al | Sn | S | Fe |
| 11.5 to 12.5 | 0.12 to 0.15 | 0.2 to 0.65 | 0.25 max | 0.3 max | 0.75 max | 0.5 max | 0.5 max | 0.1 max | 0.05 to 0.20 | 0.25 max | .025 max | .025 max | Balance |

Various steam turbine buckets having vane lengths of about 52 inches were formed in accordance with the invention using the above chromium stainless alloy composition ranges. As noted above, a number of design factors can affect the final bucket profile and specific alloy employed, such as the active length of the bucket, the pitch diameter and the operating speed of the bucket in the operative flow regions. Damping, bucket fatigue and corrosion resistance of the alloy at the maximum anticipated operating conditions also play a role in the final bucket design using chromium stainless alloys falling within the above preferred composition ranges.

After formation, each bucket according to aspects of the invention is stress relieved and the bucket surfaces machined to the finished profile using conventional finishing and heat treatment steps. The bucket is flame hardened along a leading edge to provide erosion protection in the wet steam environment. Various exemplary buckets having vane lengths of about 52 inches or greater have been subjected to conventional mechanical strength and corrosion resistance tests within the nominal and maximum anticipated operating temperatures for last stage steam turbines. The chromium stainless alloy materials used in buckets according to the invention exhibited improved corrosion resistance and better-than-average strength characteristics.

The bucket according to aspects of the present invention is preferably used in the last stage of a low pressure section of a steam turbine. However, the bucket could also be used in other stages or other sections (e.g., high or intermediate) as well. One preferred span length for bucket 20 is about 52 inches and this radial length can provide a last stage exit annulus area of about 172 $ft^2$ (or about 16.0 $m^2$). This enlarged and improved exit annulus area can decrease the loss of kinetic energy the steam experiences as it leaves the last stage buckets. This lower loss provides increased turbine efficiency.

As embodied by aspects of the present invention, an improved bucket for a steam turbine has been provided. The bucket is preferably used in the last stage of a low pressure section of a steam turbine. The bucket's integral tip shrouds and part span dampers provides improved stiffness and damping characteristics. The curved axial entry dovetail also improves the distribution of average and local stresses at the dovetail interface. The wing-shaped part span shroud enhances aerodynamic performance of the bucket.

While the invention has been described in terms of various specific embodiments, those skilled in the art will recognize that the invention can be practiced with modification within the spirit and scope of the claims.

What is claimed is:

1. A bucket for use in the low pressure section of a steam turbine, the bucket being formed with a vane length of at least about 52 inches and comprising:

a dovetail section disposed near an inner radial position of the bucket;

a tip shroud disposed near an outer radial position of the bucket;

a part span shroud disposed at an intermediate radial position and comprising a wing shaped aerodynamic airfoil, the intermediate radial position located between the inner and outer radial positions on a suction side and a pressure side of the vane; and wherein the bucket is comprised of a chromium-stainless alloy.

2. The bucket according to claim 1, wherein the dovetail section is comprised of a curved, axial-entry dovetail.

3. The bucket according to claim 1, wherein the curved, axial-entry dovetail includes four hooks.

4. The bucket according to claim 1, wherein the curved, axial-entry dovetail includes an axial retention element adapted to receive a split lockwire to prevent axial movement of the bucket within.

5. The bucket according to claim 1, wherein the bucket comprises a last stage bucket.

6. The bucket according to claim 1, wherein the part span shroud is disposed for aerodynamic performance at approximately 46% of vane length between the inner radial position and the outer radial position.

7. The bucket according to claim 1, wherein the wing shaped aerodynamic airfoil of the part span shroud includes a substantially constant profile presented to steam flow from root end to tip end.

8. The bucket according to claim 1, wherein a leading edge is flame hardened.

9. A steam turbine comprising a low pressure turbine section, the low pressure turbine section comprising:

a plurality of last stage buckets arranged about a turbine wheel, the plurality of last stage buckets having a vane length of about 52 inches or greater, at least one last stage bucket comprising:

a dovetail section disposed near an inner radial position of the at least one last stage bucket;

a tip shroud disposed near an outer radial position of the at least one last stage bucket;

a part span shroud disposed at an intermediate radial position, the intermediate radial position located between the inner and outer radial positions, and the intermediate radial positioning being adapted to promote aerodynamic performance of the part span shroud;

wherein the part span shrouds of the plurality of last stage buckets are configured to have a gap between a part span shroud of an adjacent last stage bucket; and wherein each of the plurality of last stage buckets are comprised of a chromium-stainless alloy.

10. The steam turbine according to claim 9, wherein the plurality of last stage buckets comprise an exit annulus area of about 172 $ft^2$ or more.

11. The steam turbine according to claim 9, wherein a the plurality of last stage buckets rotate at an operating speed of about 1,800 rpm.

12. The steam turbine according to claim 9, wherein the tip shrouds of the plurality of last stage buckets are configured to have a gap between a tip shroud of an adjacent last stage bucket, and wherein the gap is closed as the turbine wheel rotates above a predetermined speed and the plurality of last stage buckets untwist due to the rotation of the turbine wheel.

13. The steam turbine according to claim 9, wherein the gap is closed as the turbine wheel rotates above a predetermined speed and the last stage buckets untwist due to the rotation of the turbine wheel.

14. The steam turbine according to claim 9, wherein the wherein the part span shroud is disposed for aerodynamic performance at approximately 46% of vane length between the inner radial position and the outer radial position.

15. The steam turbine according to claim 14, wherein the part span shroud comprises a wing shaped aerodynamic airfoil.

16. The steam turbine according to claim 15, wherein the wing shaped aerodynamic airfoil includes a substantially constant profile presented to steam flow from root end to tip end.

17. The steam turbine according to claim 9, wherein the dovetail section comprises a curved, axial-entry dovetail.

18. The steam turbine according to claim 17, wherein the curved, axial-entry dovetail includes four hooks.

19. The steam turbine according to claim 18, wherein the curved, axial-entry dovetail includes an axial retention element adapted to receive a split lockwire to prevent axial movement of the bucket within.

20. A steam turbine comprising a low pressure turbine section, the low pressure turbine section comprising:

a plurality of last stage buckets arranged about a turbine wheel, the plurality of last stage buckets having a vane length of about 52 inches or greater, at least one last stage bucket comprising:

a dovetail section disposed near an inner radial position of the at least one last stage bucket;

a tip shroud disposed near an outer radial position of the at least one last stage bucket;

a part span shroud disposed at an intermediate radial position, the intermediate radial position located between the inner and outer radial positions, and the intermediate radial positioning being adapted to promote aerodynamic performance of the part span shroud; and wherein the part span shroud comprises a wing shaped aerodynamic airfoil having a substantially constant profile presented to steam flow from root end to tip end.

* * * * *